US007997909B2

(12) United States Patent
Xu et al.

(10) Patent No.: US 7,997,909 B2
(45) Date of Patent: Aug. 16, 2011

(54) CABLE ASSEMBLY WTH EMI PROTECTION

(75) Inventors: Bin Xu, Kunshan (CN); Su-Feng Liu, Kunshan (CN); Chin-Te Lai, Tu-Cheng (TW); Dong-Sheng Li, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/732,422

(22) Filed: Mar. 26, 2010

(65) Prior Publication Data

US 2010/0248544 A1 Sep. 30, 2010

(30) Foreign Application Priority Data

Mar. 26, 2009 (CN) ..... 2009 0 301628

(51) Int. Cl.
*H01R 12/00* (2006.01)

(52) U.S. Cl. ..... 439/76.1; 439/607.57

(58) Field of Classification Search ..... 439/76.1, 439/607.55–607.57
See application file for complete search history.

(56) References Cited

U.S. PATENT DOCUMENTS 5,797,771 A * 8/1998 Garside ..... 439/607.46
7,175,444 B2 * 2/2007 Lang et al. ..... 439/76.1
7,232,329 B1 * 6/2007 Wu ..... 439/358
7,261,582 B2 * 8/2007 Wu ..... 439/352
7,303,438 B2 * 12/2007 Dawiedczyk et al. ... 439/607.53
7,410,365 B2 * 8/2008 Wu ..... 439/76.1
7,445,484 B2 * 11/2008 Wu ..... 439/352
7,448,897 B2 * 11/2008 Dawiedczyk et al. ..... 439/357
7,491,089 B2 * 2/2009 Lang et al. ..... 439/607.01
7,559,785 B1 * 7/2009 Wu ..... 439/352
7,572,138 B1 * 8/2009 Wu ..... 439/352
7,601,010 B1 * 10/2009 Wu ..... 439/76.1
7,651,342 B1 * 1/2010 Wu ..... 439/76.1
7,654,831 B1 * 2/2010 Wu ..... 439/76.1
7,798,821 B2 * 9/2010 Liu et al. ..... 439/76.1
7,857,650 B1 * 12/2010 Wu ..... 439/352
7,891,986 B2 * 2/2011 Wu ..... 439/76.1
7,909,661 B2 * 3/2011 Wu ..... 439/701
2006/0134993 A1 * 6/2006 Dawiedczyk et al. ..... 439/676
2006/0189199 A1 * 8/2006 Lang et al. ..... 439/374
2006/0189211 A1 * 8/2006 Lang et al. ..... 439/607
2007/0105410 A1 * 5/2007 Wu ..... 439/76.1
2007/0161281 A1 * 7/2007 Wu ..... 439/352
2009/0197438 A1 * 8/2009 Liu et al. ..... 439/76.1

(Continued)

*Primary Examiner* — Ross N Gushi
(74) *Attorney, Agent, or Firm* — Wei Te Chung; Andrew C. Cheng; Ming Chieh Chang

(57) ABSTRACT

A cable assembly (1) comprises an insulative housing (2) having a body portion with a front surface and a pair of upper and lower tongue portions (212, 222) respectively extending forwardly form a top and bottom sides of the front surface of the body portion; the body portion defines a receiving room therein. A printed circuit board (3) is disposed in the receiving room of the body portion of the housing and defines a mating portion (31) extending forwardly from the front surface of the housing and disposed between the upper and lower tongue portions, a terminating portion (32) opposite to the mating portion and a connecting portion (33) connected with the mating portion and the terminating portion. The connecting portion and the terminating portion are received in the receiving room. A cable (4) is terminated to the terminating portion of the printed circuit board and extending out of the housing. And, a shielding member (5) received in the receiving room and surrounding the printed circuit board (3).

20 Claims, 8 Drawing Sheets

U.S. PATENT DOCUMENTS

2009/0215290 A1* 8/2009 Zhu et al. ..... 439/76.1
2010/0203754 A1* 8/2010 Li et al. ..... 439/345
2010/0248544 A1* 9/2010 Xu et al. ..... 439/607.04
2011/0045702 A1* 2/2011 Su et al. ..... 439/607.56

* cited by examiner

CABLE ASSEMBLY WTH EMI PROTECTION

FIELD OF THE INVENTION

The present invention relates to a cable assembly, and more particularly to a high speed cable assembly with a metallic shielding member therein for EMI protection.

DESCRIPTION OF PRIOR ART

Generally, a few of cable assembly used in an internal space of a server or other electrical device will not be influenced by EMI seriously, the cable assembly do not have a shield for anti-EMI. However, as more and more high speed cable assemblies are applied in the internal of the server or other electrical device, the cable assembly will be influenced by EMI more or less which are produced by other electrical components in the server or itself. If the cable assembly is influenced by EMI, the stability of signal transmission of the cable assembly will be affected.

For example, U.S. Pat. No. 7,303,438 B2 discloses a high speed cable assembly applied in an internal space of the server, and it comprises an insulative housing, a printed circuit board disposed in the insulative housing and a cable electrically connected with a rear end of printed circuit board and extending rearwardly and out of the insulative housing. Obviously, the cable assembly will be influenced by EMI. In addition, if the housing of the cable assembly is formed by metallic material, although the function of the EMI protection is improved. However, the cost of the cable assembly will also be increased, and the manufacturing process of the metallic housing is also complicated.

As discussed above, an improved cable assembly overcoming the shortages of existing technology is needed.

SUMMARY OF THE INVENTION

Accordingly, an object of the present invention is to provide a cable assembly with EMI protection.

In order to achieve the above-mentioned objects, a cable assembly comprises an insulative housing having a body portion with a front surface and an upper and a lower tongue portions respectively extending forwardly form a top and bottom sides of the front surface of the body portion; the body portion defines a receiving room therein. A printed circuit board is disposed in the receiving room of the body portion of the housing and defines a mating portion extending forwardly from the front surface of the housing and disposed between the upper and lower tongue portions, a terminating portion opposite to the mating portion and a connecting portion connected with the mating portion and the terminating portion. The connecting portion and the terminating portion are received in the receiving room. A cable is terminated to the terminating portion of the printed circuit board and extending out of the housing. And, a shielding member received in the receiving room and surrounding the printed circuit board.

Other objects, features and advantages of the invention will be apparent from the following detailed description taken in connection with the accompanying drawings.

DETAILED DESCRIPTION OF PREFERRED EMBODIMENTS

Figure 1:
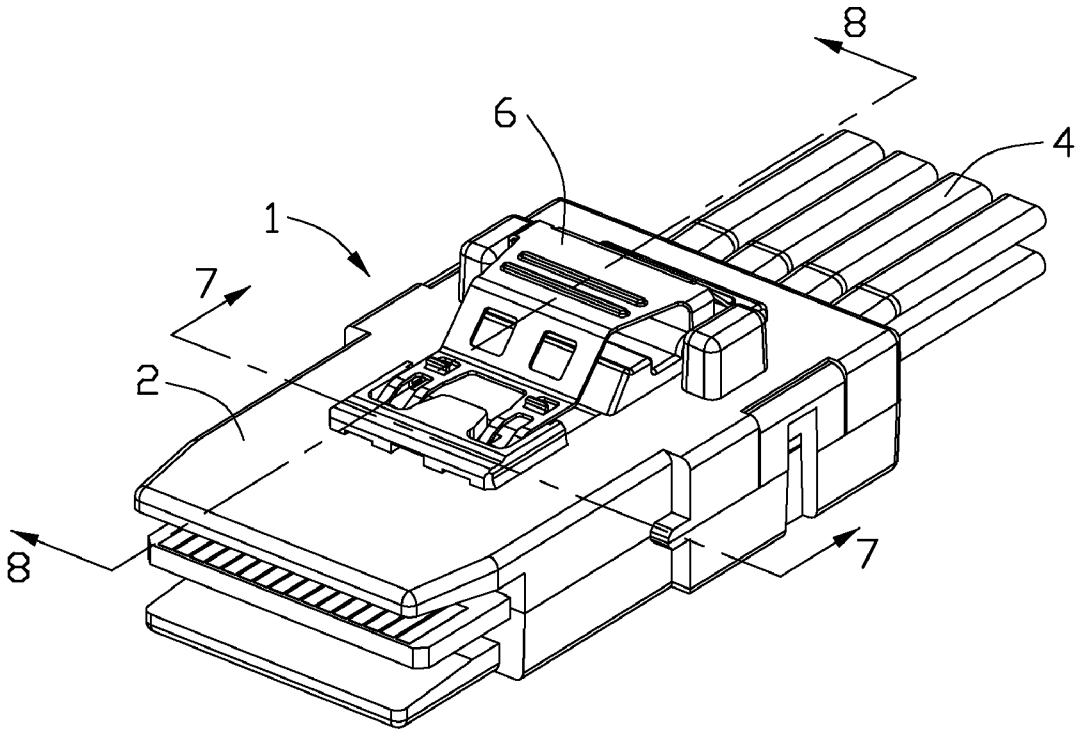
FIG. 1 is a perspective view of a cable assembly in accordance with the present invention.
Figure 2:
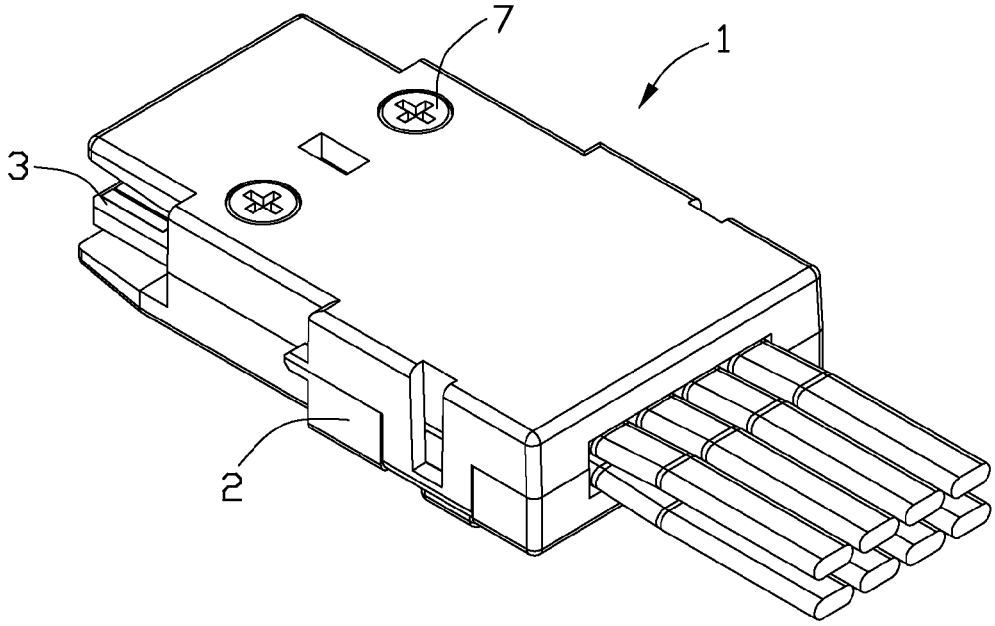
FIG. 2 is similar to FIG. 1, but viewed from another aspect.

Reference will now be made to the drawing figures to describe the present invention in detail.

FIGS. 1 to 5 illustrate perspective views of a cable assembly 1 made in accordance with the present invention. The cable assembly 1 comprises a housing 2 and a printed circuit board 3 disposed in the housing 2. A plurality of cables 4 are electrically connected to a rear end of the printed circuit board 3 and extend out of the housing 2 along front to rear direction. A shielding member 5 is disposed in the housing 2 and surrounds a middle and rear portion of the printed circuit board 3 and a front portion of the plurality of cables 4. A latch 6 is assembled to the housing 2. The cable assembly 1 further comprises a pair of screws 7 for locking the printed circuit board 3 to the housing 2.

Referring to FIGS. 1 to 4, the housing 2 is made of insulative material and includes an upper cover 21 and a lower cover 22 engaged with other.

Referring to FIGS. 3 to 6, the upper cover 21 defines a first body portion 211 and an upper tongue portion 212 extending forwardly from a front face of the first body portion 211 for a distance. The upper cover 21 defines a first groove 213 extending upwardly from a bottom surface thereof. The upper cover 21 further defines a generally M-shaped interferential portion 214 formed on a top surface thereof, a platform portion 215 protruding upwardly from a bottom surface to a top surface thereof and a pair of ear portions 216 disposed at two sides of the platform portion 215. The platform portion 215 is disposed in the back of the interferential portion 214 in a front to rear direction. A pair of wedge-shaped protrusive portions 217 are respectively formed at two lateral surfaces of the upper cover 21. Three receiving holes 218 are formed on a front side of the bottom surface of the first body portion 211 of the upper cover 21 and arranged in a transversal direction.

The lower cover 22 defines a second body portion 221 and a lower tongue portion 222 extending forwardly from a front face of the second body portion 212 for a distance. The lower cover 22 defines a second groove 223 extending downwardly from a top surface of the lower cover 22. The second body portion 221 defines a positioning post 224 extending upwardly from a front side of a top surface of the second body portion 221 and disposed at a middle section along a transversal direction. A pair of through holes 225 are formed in the lower cover 22 and disposed at two sides of the positioning post 224 along a transversal direction. In addition, the lower cover 22 further defines a pair of latching portions 226 extending upwardly from the two sides of body portion 221 of the lower cover 22 for interlocking with the protrusive portion 217 of the upper cover 21. It should be noted that the positioning post 224 can be received into a middle receiving hole 218 of the three receiving holes 218 when the upper cover 21 and the lower cover 22 engaged with other. The pair of through holes 225 are in alignment with the two side receiving holes 218 of the three receiving holes 218 in a vertical direction.

Figure 3:
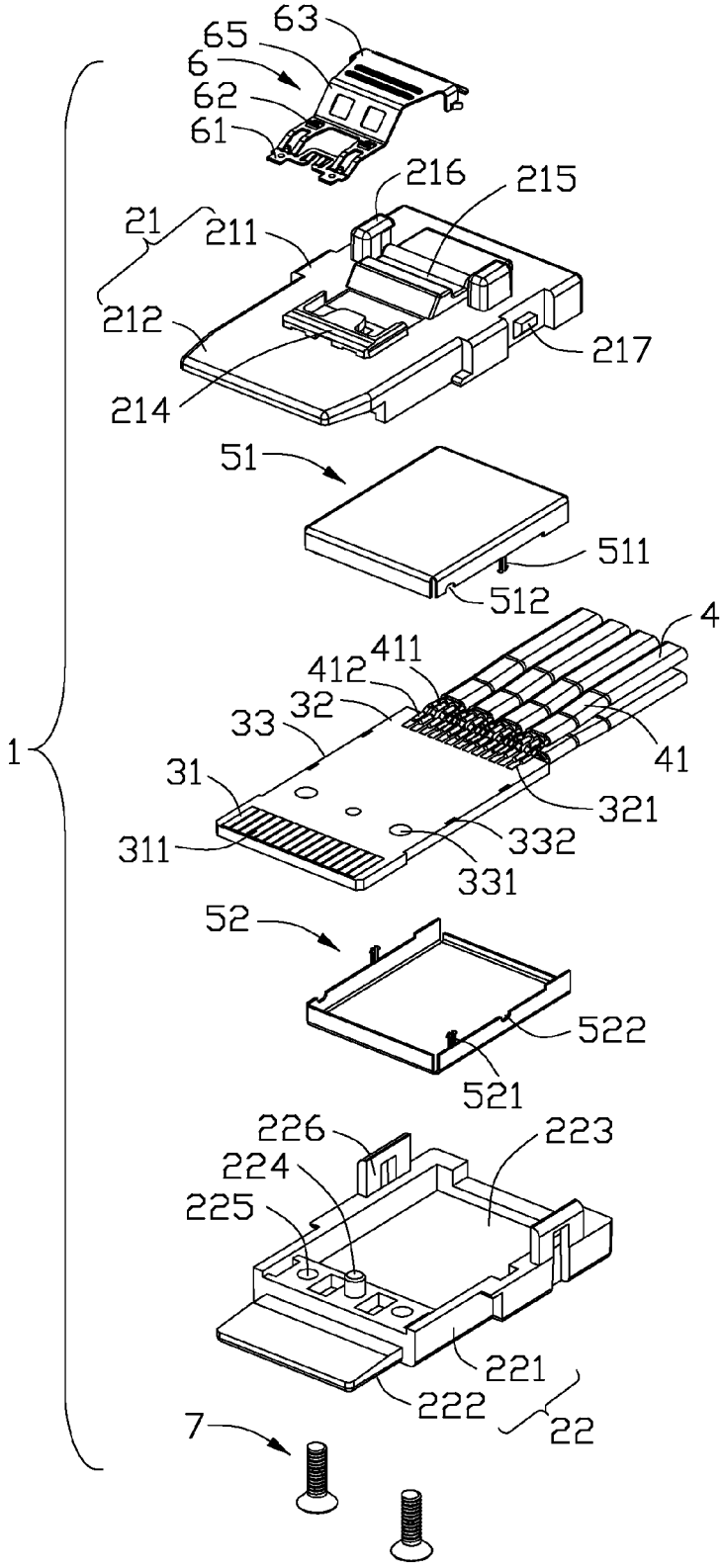
FIG. 3 is an exploded, perspective view of the cable assembly of FIG. 1.
Figure 4:
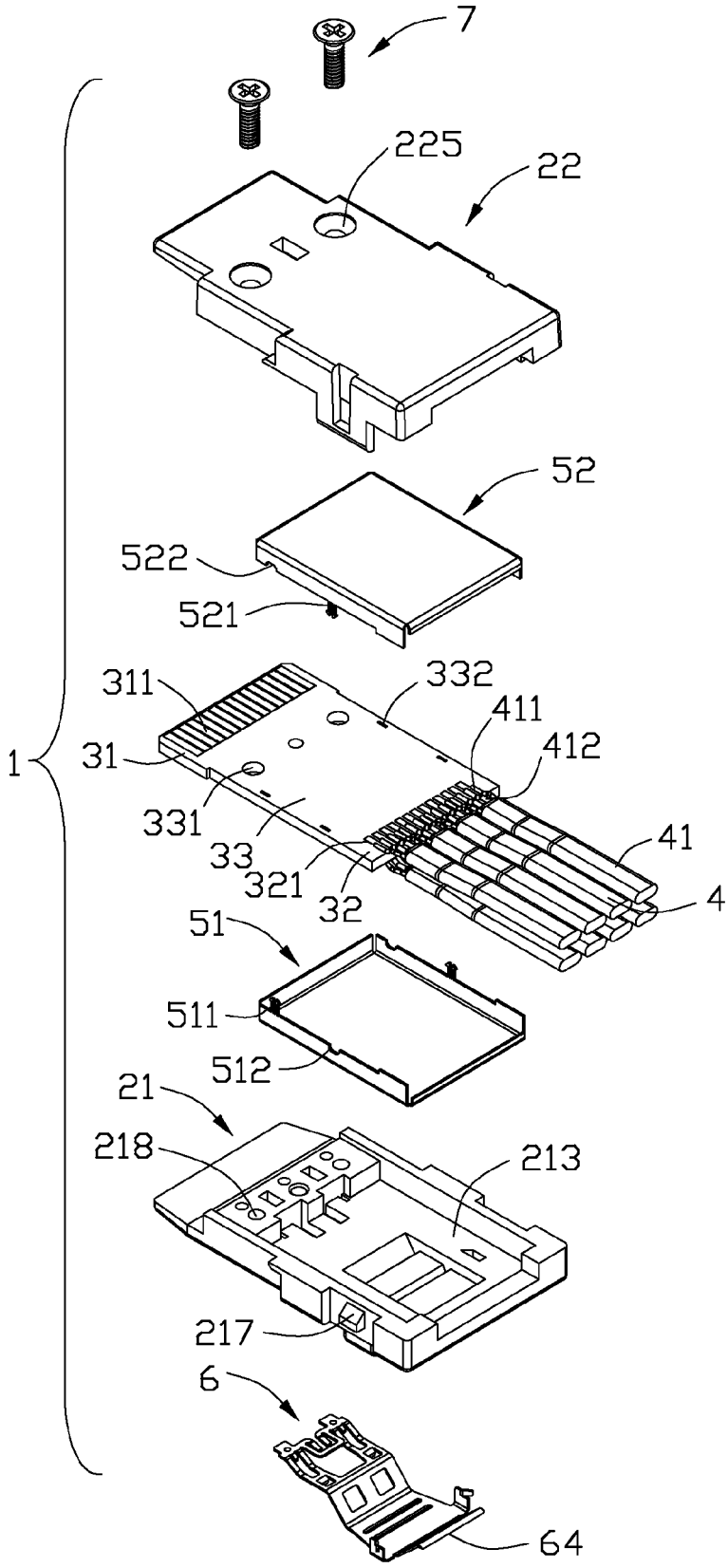
FIG. 4 is an exploded, perspective view of the cable assembly of FIG. 2.
Figure 5:
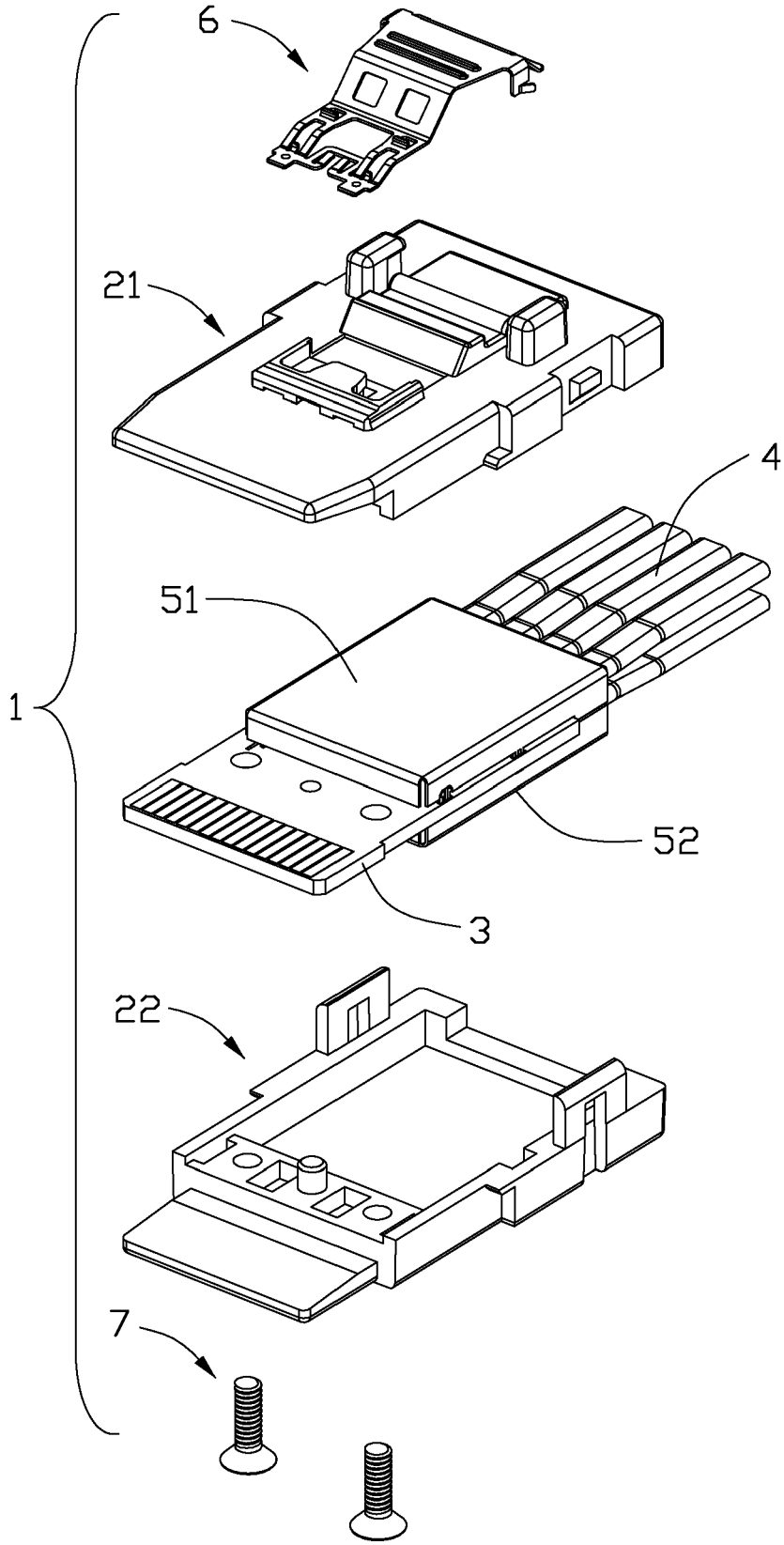
FIG. 5 is a partially assembled view of the cable assembly of FIG. 1.
Figure 6:
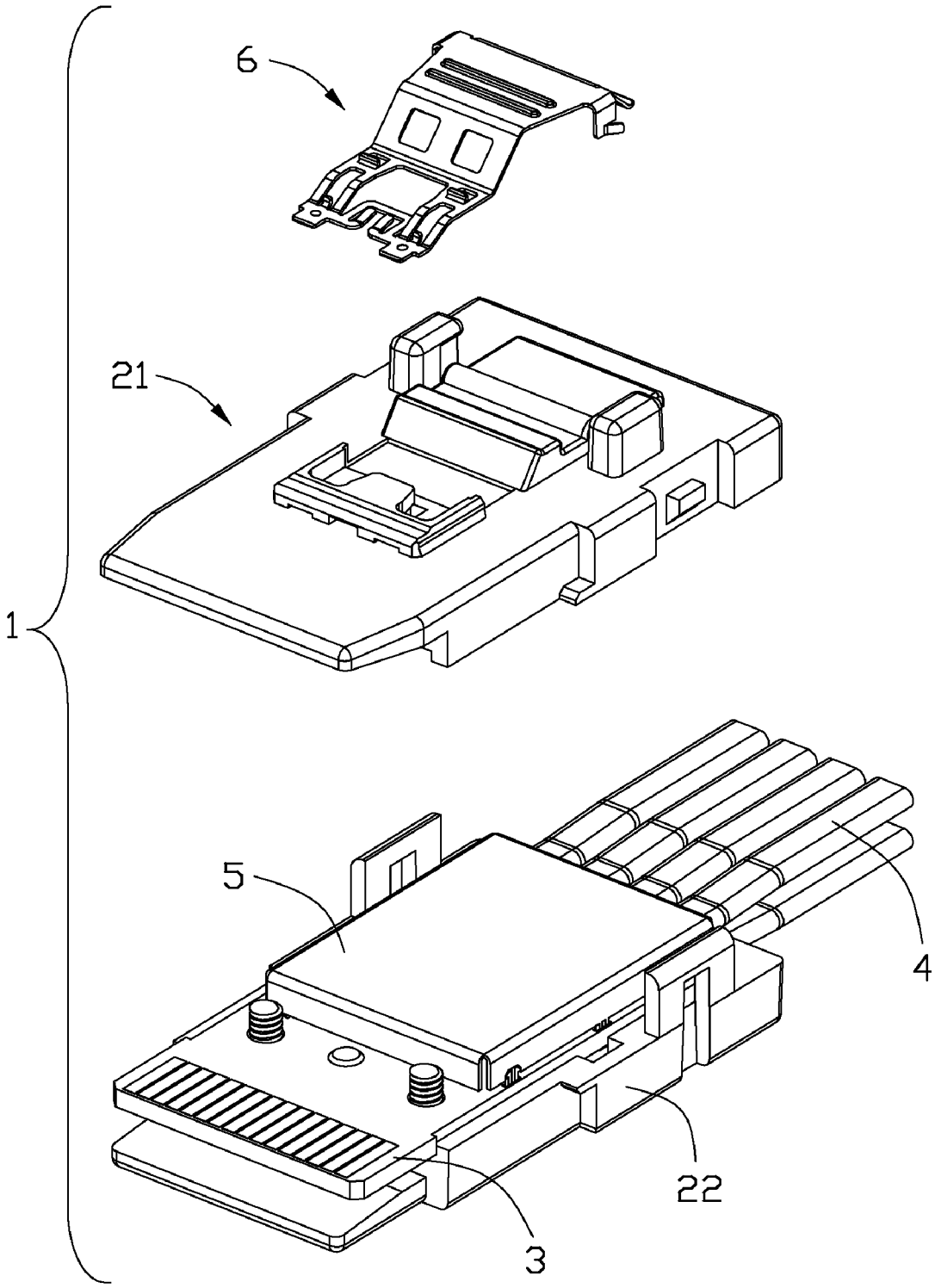
FIG. 6 is an another partially assembled view of the cable assembly of FIG. 5.
Figure 7:
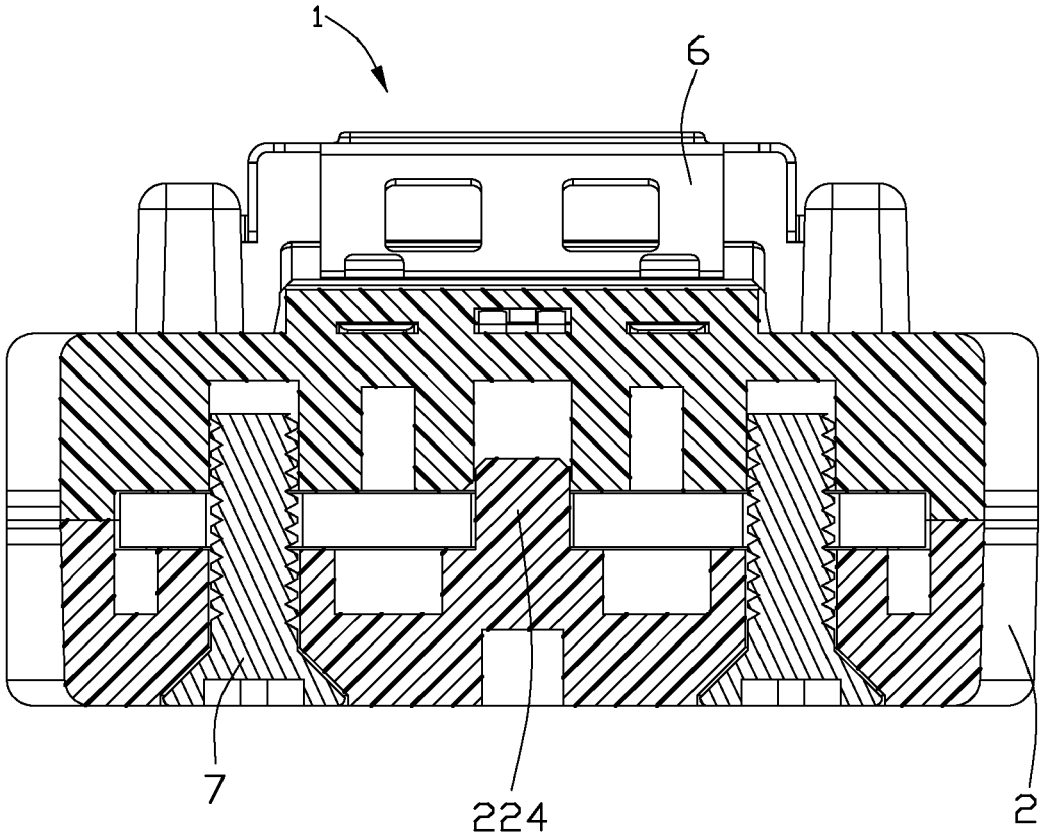
FIG. 7 is a cross section view of the cable assembly of FIG. 1 taken along line 7-7.
Figure 8:
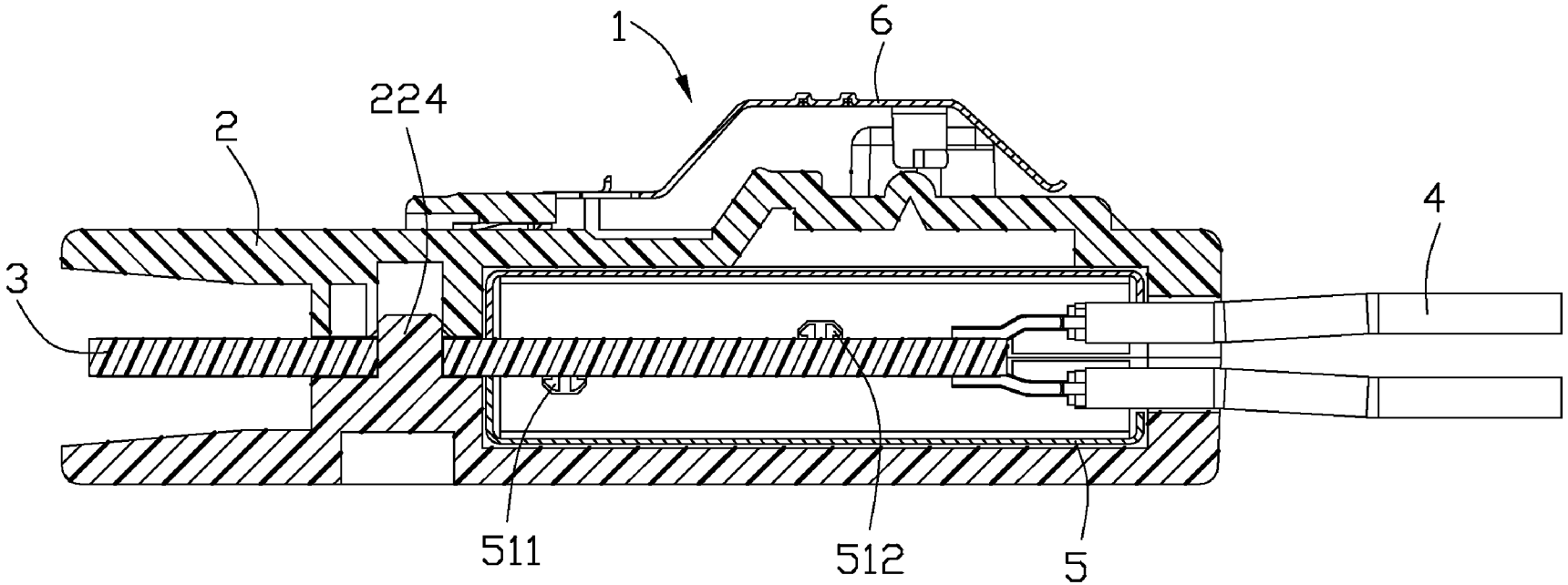
FIG. 8 is a cross section view of the cable assembly of FIG. 1 taken along line 8-8.

Referring to FIGS. 3 and 4, a printed circuit board 3 disposed in the housing 2 defines a mating portion 31 with a plurality of conductive pads 311 thereon, a terminating portion 32 opposite to the mating portion 31 and with a plurality of conductive pads 321 for terminating to a plurality of cables 4 and a connecting portion 33 connected with the mating portion 31 and the terminating portion 32. The mating portion 31 is wider than the terminating portion 32 and the mating portion 31. The conductive pads 311, 321 are respectively arranged on opposite upper and lower surfaces of the mating portion 31 and the terminating portion 32 of the printed circuit board 3 in a transversal direction. The connecting portion 33 has three positioning holes 331 adjacent to the mating portion 31. The printed circuit board 3 further defines two spaced slits 332 at each lateral side thereof. The two slits 332 are in line along a longitudinal direction.

Referring to FIGS. 3 and 4, a plurality of cables 4 terminated to the printed circuit board 3 comprises two sets of sub-assemblies in a stacked relationship. Each sub-assembly comprises four serial Attached Technology Attachment (ATA) standard cables 41 for high speed signal transmission. Each Serial ATA standard cable 41 comprises a pair of signal conductors 411 respectively transmitting positive signal and negative signal, and a pair of grounding conductors 412 arranged at opposite outer sides of the pair of signal conductors 41 for providing grounding to the signal transmission.

Referring to FIGS. 3 to 6 and 8, the shielding member 5 is stamped and formed from a metallic plate and comprises an upper shell 51 and a lower shell 52 engaged with each other. The upper and lower shells 51, 52 are both like a rectangular cover and can be respectively received into the first and second grooves 213, 223. The upper shell 51 defines a barb 511 and a cutout 512 at each lateral side thereof. The lower shell 52 also defines a barb 521 and a cutout 522 at each lateral side thereof. And, the barb 521 of the lower shell 52 can be engaged with the cutout 512 of the upper shell 51. The barb 511 of the upper shell 51 can be engaged with the cutout 522 of the lower shell 52.

Referring to FIGS. 3 and 4, the latch 6 is stamped and formed from a metallic plate and comprises a retaining portion 61, a pair of generally L-shaped locking portions 62 extending upwardly and rearwardly from the retaining portion 61, a N-shaped pressing portion 63 formed at a rear position of the pair of locking portions 62, and an inclined supporting portion 64 slantwise extending from the pressing portion 63. The latch 5 further defines an inclined intermediate portion 65 connecting the pressing portion 63 with the locking portions 62.

Referring to FIGS. 2 to 7, the pair of screws 7 are used for locking with the lower cover 22, the printed circuit board 3 and the upper cover 21 together. Each screw 7 can pass through a through hole 225 of the lower cover 21, a positioning hole 331 of the printed circuit board 3 and cooperates with a receiving hole 218 of the upper cover 21. Thus, the lower cover 22, the printed circuit board 3 and the upper cover 21 can be locked with each other by the pair of screws 7.

Referring to FIGS. 1 to 8, the assembling process of the cable assembly 1 made in according to the present invention starts from arranging the cables 4 into two levels and soldering the signal conductors 411 and the grounding conductors 412 of each Serial ATA standard cable 41 to the conductive pads 321 of the terminating portion 32 of the printed circuit board 3.

After the cables 4 are soldered to the printed circuit board 3, then assembling the upper shell 51 and the lower shell 52 respectively to the upper and lower sides of the printed circuit board 3. Each barb 511 of the upper shell 51 passes through a slit 332 of the printed circuit board 3 and cooperates with the cutout 522 of the lower shell 52. And, each barb 521 of the lower cover 52 passes through a slit 332 of the printed circuit board 3 and cooperates with the cutout 512 of the upper shell 51. Thus, the upper shell 51, the printed circuit board 3 and the lower shell 52 are engaged with each other. And, the shielding member 5 surrounds a middle and rear portion of the printed circuit board 3 and a front portion of the plurality of cables 4.

After the shielding member 5 assembled to the printed circuit board 3, then assembling the printed circuit board 3, the cables 4 and the shielding member 5 to the lower cover 22 together. The lower shell 52 is received into the second groove 223 of the lower cover 22. The printed circuit board 3 is supported by the top surface of the second body portion 221. A positioning post 224 of the lower cover 22 passes through a positioning hole 331 of the printed circuit board 3. Thus, the shielding member 5 and the printed circuit board 3 are preliminarily positioned with the lower cover 22. The mating portion 31 of the printed circuit board 3 is paralleled and spaced apart with the lower tongue portion 222 in a vertical direction.

After the printed circuit board 3, the shielding member 5 and the cable 4 are assembled to the lower cover 22, then assembling the upper cover 21 to the lower cover 22. The bottom surface of the upper cover 21 attaches to the top surface of lower cover 21 after the upper cover 21 is completely assembled to the lower cover 22. Thus, the upper shell 51 is received into the first groove 213 of the upper cover 21. And a top end of the positioning post 224 of the lower cover 22 is received into a receiving hole 218 of the upper cover 21. In addition, the pair of latching portions 226 of the lower cover 22 are locked with the pair of protrusive portions 217 of the upper cover 21 to form the housing 2. The mating portion 31 of the printed circuit board 3 is disposed between the upper tongue portion 212 and the lower tongue portion 222 in a vertical direction.

After the upper cover 21 is assembled to the lower cover 22, then assembling a pair of screws 7 to the housing 2. The front portion of each screw 7 passes through the corresponding through hole 225 and cooperates with the receiving hole 218. Thus, the lower cover 21, the upper cover 22, the stand and the printed circuit board 3 are engaged with each other by the screws 6.

Finally, assembling a latch 6 to the top surface of the housing 2. A forward pressing force is exerted on the latch 6. The retaining portion 61 is engaged with the engaging portion 214 to make the latch 5 positioned on upper cover 21. The pressing portion 63, the inclined supporting portion 644, the inclined intermediate portion 65 and the locking portions 22 are cantilevered relative to the retaining portion 61. The two sides of pressing portion 63 are interferential with the pair of ear portions 216 to limit the excessive movement of the pressing portion 63 in a down to up direction.

After the above assembling steps, the entire process of assembling of the cable assembly 1 is finished. As a shielding member 5 is disposed in the housing 2 and surrounds a portion of the printed circuit board 3 and the cable 4, so an effect of anti-EMI of the cable assembly 1 will be enhanced. And, the cost of the cable assembly 1 will not be increased too much. In a word, the cable assembly 1 applied in an internal space of the server will not be influenced by EMI seriously due to the EMI protection thereof.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an insulative housing having a body portion with a front surface and an upper and a lower tongue portions respectively extending forwardly form a top and bottom sides of the front surface of the body portion, the body portion defining a receiving room therein;

a printed circuit board disposed in the receiving room of the body portion of the housing and defining a mating portion extending forwardly from the front surface of the housing and disposed between the upper and lower tongue portions, a terminating portion opposite to the mating portion and a connecting portion connected with the mating portion and the terminating portion, the connecting portion and the terminating portion received in the receiving room;

a cable terminated to the terminating portion of the printed circuit board and extending out of the housing; and a shielding member received in the receiving room and surrounding the printed circuit board.

2. The cable assembly as recited in claim 1, further comprising a latch assembled to a top surface of the housing.

3. The cable assembly as recited in claim 2, wherein the upper and lower shells respectively define at least one barb and cutout at two sides thereof, each barb of upper shell passes through the printed circuit board and cooperates with a corresponding cutout of the lower shell, and each barb of lower shell passes through the printed circuit board and cooperates with a corresponding cutout of the upper shell.

4. The cable assembly as recited in claim 2, wherein the housing further defines an interferential portion formed on a top surface thereof, a platform portion formed on the surface and disposed in back of the interferential portion and a pair of ear portions disposed at two sides of the platform portion.

5. The cable assembly as recited in claim 4, wherein the latch comprises a retaining portion engaged with the engaging portion, a pair of locking portions extending upwardly and rearwardly from the retaining portion, a pressing portion formed at a rear position of the pair of locking portions, an inclined supporting portion slantwise extending from the pressing portion, and an inclined intermediate portion connecting the pressing portion with the locking portions.

6. The cable assembly as recited in claim 1, wherein the shielding member defines an upper shell and a lower shell respectively disposed on an upper and a lower sides of the printed circuit board and engaged with each other.

7. The cable assembly as recited in claim 1, wherein the housing defines an upper cover and a lower cover engaged with each other.

8. The cable assembly as recited in claim 7, wherein the lower cover defines a positioning post passing through a positioning holes of the printed circuit board and extending into a receiving hole formed in a lower surface of the upper cover.

9. The cable assembly as recited in claim 7, wherein the lower cover defines a pair of latching portions at two sides thereof, the upper cover defines a pair of protrusive portions at two lateral surfaces thereof, and each latching portion of lower cover engages with a corresponding protrusive portion of the upper cover.

10. The cable assembly as recited in claim 7, wherein further comprising a pair of screws assembled to the housing to interlock with the upper cover, the printed circuit board and the lower cover.

11. A cable assembly, comprising:

a housing having a base portion and a pair of tongue portions extending forwardly from a front surface of the base portion, the base portion having a receiving room therein;

a printed circuit board disposed in the receiving room and having a mating portion extending forwardly from the front surface of the base portion, the mating portion of the printed circuit disposed between the pair of tongue portions in a vertical direction;

a plurality of cables electrically connected to a rear end of the printed circuit board and extending out of the housing;

a shielding member surrounding a portion of the printed circuit board and a front portion of each cable disposed in the receiving room;

a latch attached to a top surface of the housing; and a pair of screws interlocking with the printed circuit board and the housing.

12. A cable assembly as recited in claim 11, wherein the shielding member includes an upper shell and a lower shell engaged with each other and respectively disposed at two sides of the printed circuit board in a vertical direction.

13. A cable assembly as recited in claim 12, wherein the upper shell defines at least one barb passing through the printed circuit board and received into corresponding cutout formed in the lower shell, the lower shell also defines at least one barb passing through the printed circuit board and received into corresponding cutout formed in the upper cover.

14. A cable assembly as recited in claim 11, wherein the housing includes an upper cover and a lower cover engaged with each other.

15. A cable assembly as recited in claim 14, wherein lower cover defines a positioning post passing through a positioning holes of the printed circuit board and extending into a receiving hole formed in a lower surface of the upper cover.

16. A cable connector assembly comprising:

an insulative housing including an upper half and a lower half respectively forming an upper tongue portion and a lower tongue portion thereof;

a printed circuit board located and sandwiched between the upper half and the lower half and defining upper and lower surfaces thereof;

an upper set of wires and a lower set of wires mechanically and electrically connected to the upper surface an the lower surface, respectively;

an upper metallic shell located upon and enclosing the upper surface with an upper rear opening to allow the upper set of wires to rearwardly extend; and a lower metallic shell located upon and enclosing the lower surface with a lower rear opening to allow the lower set of wires to rearwardly extend.

17. The cable connector assembly as claimed in claim 16, wherein said upper metallic shell includes a board lock to fasten to the printed circuit board.

18. The cable connector assembly as claimed in claim 17, wherein said upper metallic shell is smaller than the printed circuit board in a top view.

19. The cable connector assembly as claimed in claim 16, wherein the upper half includes an upper rear passageway to allow the upper set of wires to rearwardly extend, and the lower half includes an lower rear passageway to allow the lower set of wires to rearwardly extend.

20. The cable connector assembly as claimed in claim 16, wherein said printed circuit board includes a first through hole into which a post unitarily extending from the housing extends, and a second through hole into which a screw extends through the housing.

* * * * *